US008578631B2

(12) United States Patent
Francello et al.

(10) Patent No.: US 8,578,631 B2
(45) Date of Patent: Nov. 12, 2013

(54) EXTENDABLE SPIKES FOR SHOES

(76) Inventors: Gene A. Francello, Escondido, CA (US); Eric Nelson, Canyon Country, CA (US); Helen K. Park, La Habra, CA (US)

( * ) Notice: Subject to any disclaimer, the term of this patent is extended or adjusted under 35 U.S.C. 154(b) by 16 days.

(21) Appl. No.: 12/802,899

(22) Filed: Jun. 16, 2010

(65) Prior Publication Data

US 2011/0047830 A1 Mar. 3, 2011

Related U.S. Application Data

(63) Continuation-in-part of application No. 12/583,670, filed on Aug. 25, 2009, now abandoned.

(51) Int. Cl.
*A43C 15/14* (2006.01)

(52) U.S. Cl.
USPC ..... 36/61; 36/127

(58) Field of Classification Search
USPC ..... 36/61, 127, 134, 59 R, 128, 7.6, 7.7
See application file for complete search history.

(56) References Cited

U.S. PATENT DOCUMENTS 2,222,747 A * 11/1940 Klein et al. ..... 12/142 P
4,763,426 A 8/1988 Polus et al.
4,873,774 A 10/1989 Lafever
4,999,932 A 3/1991 Grim
5,299,369 A * 4/1994 Goldman ..... 36/61
5,341,581 A 8/1994 Huang
5,505,010 A 4/1996 Fukuoka
5,526,589 A 6/1996 Jordan
5,697,171 A 12/1997 Phillips
5,740,619 A 4/1998 Broder
5,815,951 A 10/1998 Jordan
6,014,823 A * 1/2000 Lakic ..... 36/93
6,125,556 A 10/2000 Peckler et al.
6,256,907 B1 7/2001 Jordan et al.
6,389,714 B1 5/2002 Mack
6,675,504 B1 1/2004 Biancucci et al.
6,915,595 B2 7/2005 Kastner
7,234,250 B2 6/2007 Fogarty et al.
7,254,909 B2 8/2007 Ungari
7,269,916 B2 9/2007 Biancucci et al.
7,412,784 B1 8/2008 Bobbett
7,490,418 B2 2/2009 Obeydani
7,584,554 B2 9/2009 Fogarty et al.
2008/0066348 A1 * 3/2008 O'Brien et al. ..... 36/100

* cited by examiner

*Primary Examiner* — Ted Kavanaugh
(74) *Attorney, Agent, or Firm* — Palomar Patent; Mary Jo Redman; Calif K. Tervo

(57) ABSTRACT

Golf shoe sole 10 having extendable spikes 71 activated by compressed air from a pump 42 located inside sole of shoe. Pump 42 is operated by weight of wearer's heel on a bladder 41 located in heel of sole and check valves 51 maintain pressure in pneumatic system. Pushbutton switch 58 selects movement of spikes 71 between retracted and extended modes.

4 Claims, 4 Drawing Sheets

FIG. 6
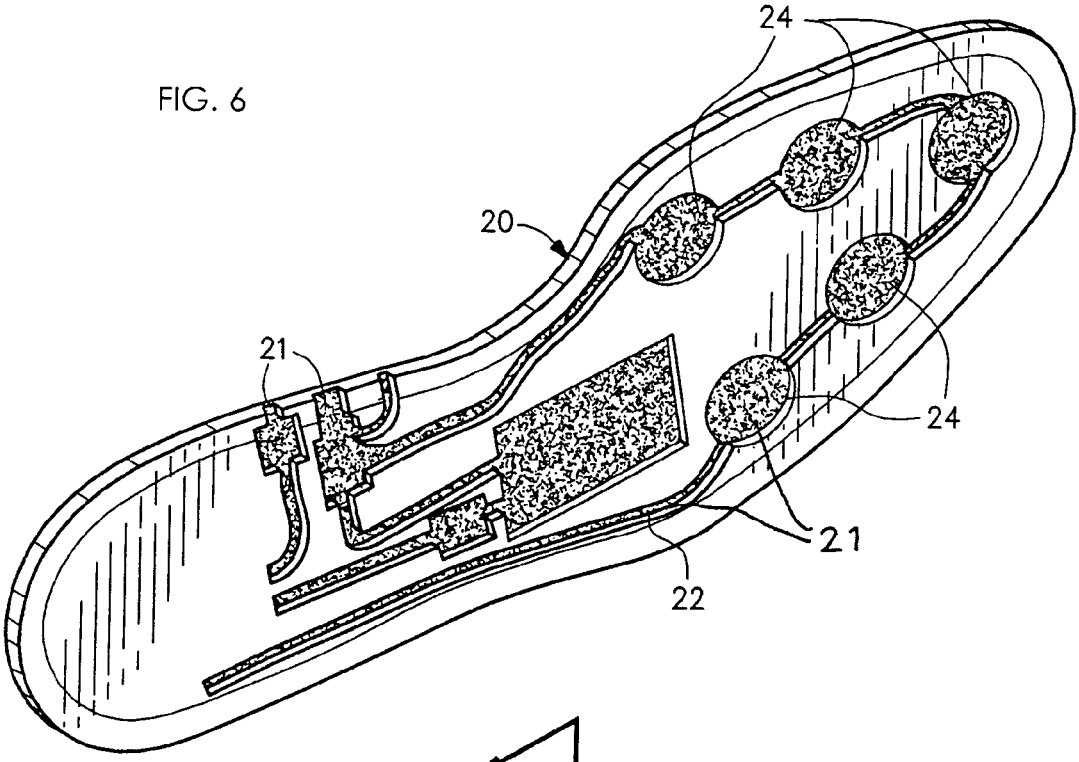
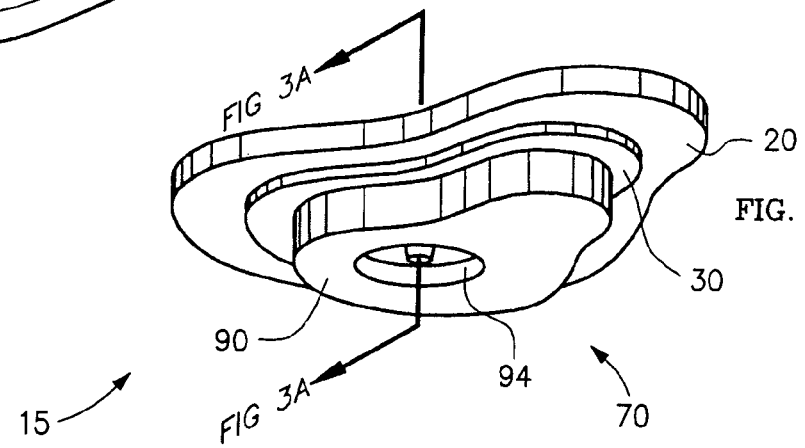
FIG. 5A
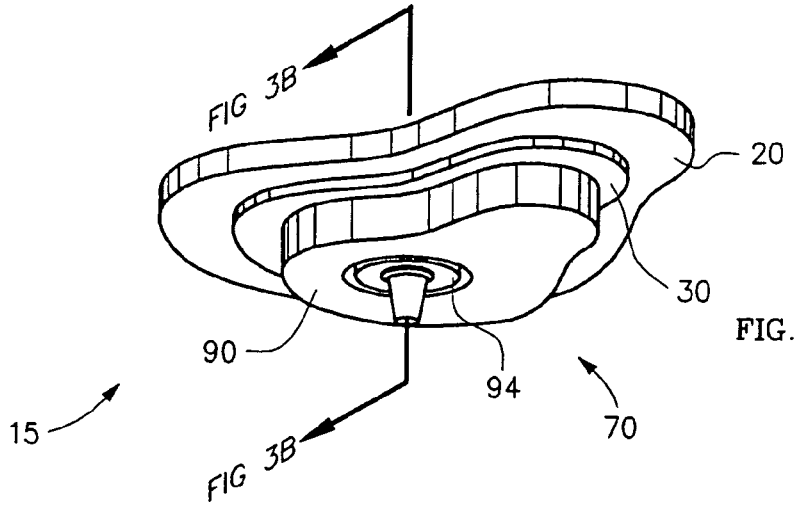
FIG. 5B

FIG. 7
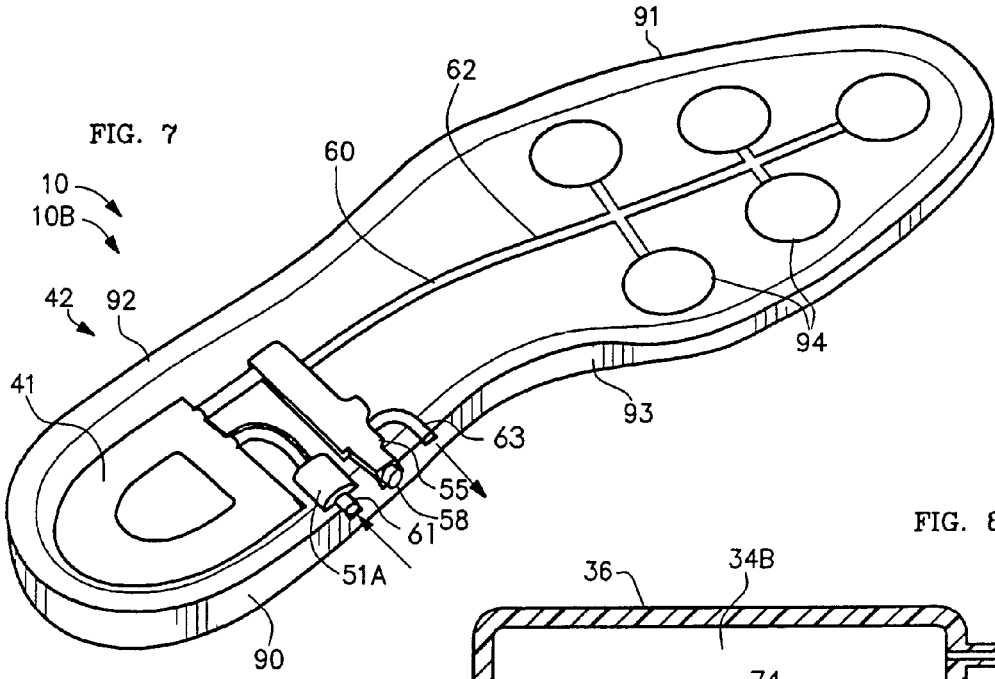
FIG. 8A
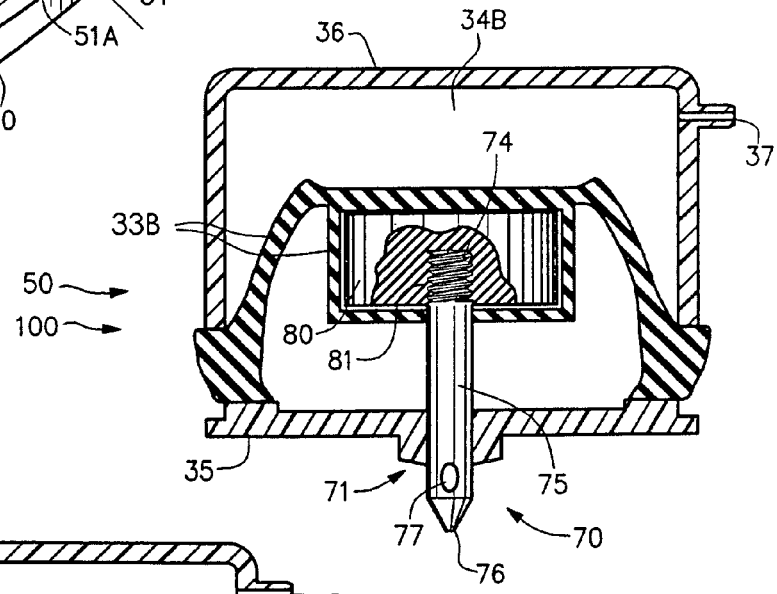
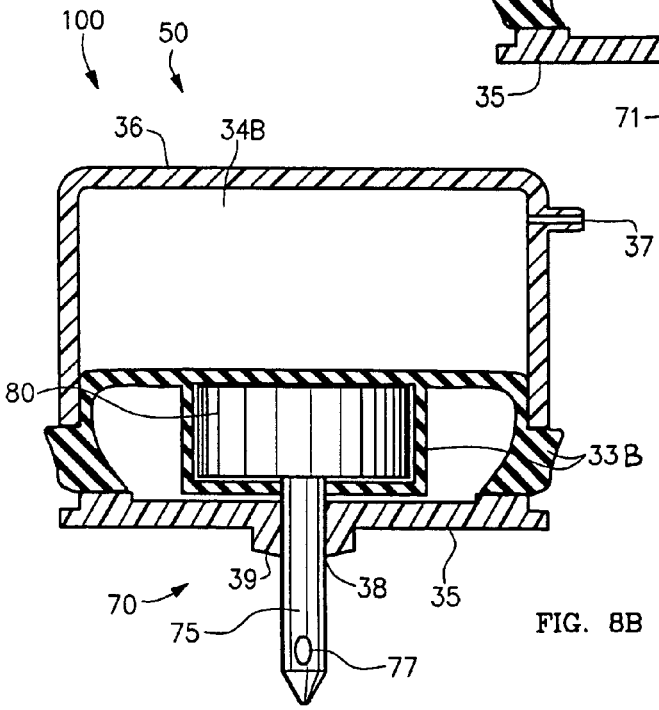
FIG. 8B

EXTENDABLE SPIKES FOR SHOES

CROSS-REFERENCE TO RELATED APPLICATIONS

This application is a continuation-in-part of and claims the benefit of U.S. patent application Ser. No. 12/583,670, filed Aug. 25, 2009, now abandoned the disclosures of which are hereby expressly incorporated by reference.

FIELD OF THE INVENTION

This invention relates generally to sports shoes and more specifically involves spikes for a shoe, which are extended or retracted by the wearer's footsteps.

BACKGROUND OF THE INVENTION

Shoes with spikes or cleats are often worn for sports that require good foot traction. For example, golf players use spiked shoes for safer and more stable walking and standing on wet grass and slopes. Other conditions where shoes with retractable spikes are desirable include walking or climbing on ice or snow.

Historically, golf shoes had small metal spikes attached to the soles, such as by a threaded connection in the sole. Such spikes were durable and provided good traction, but damaged the grass of golf courses and scratched or gouged interior floors. Golf players were typically required to remove their spiked shoes before entering offices or clubhouses associated with golf courses. Most golf courses have now even banned or restricted use of metal spikes altogether.

Another type of golf spike that is less damaging to grass and floors is a blunt spike of hard plastic, which may be single- or multi-pronged. Most golf courses allow these plastic spikes to be used both on grassy fairways and on most interior surfaces.

Plastic spikes have four main disadvantages. First, they can still damage the finely groomed grass of the greens, and even leave a slight indentation.

Second, on some surfaces, plastic spikes are more slippery than most conventional shoes. For example, on a smooth or wet floor or exterior walking surface, plastic spikes can cause the wearer to slip and fall.

Third, plastic spikes are not as durable as metal ones. Although the grass of the actual golf course does not wear out plastic spikes too quickly, walking on concrete sidewalks and parking lots, for example, does shorten the life of plastic spikes greatly.

Fourth, plastic spikes collect grass and mud that reduces their ability to provide good traction with the ground.

Attempts have been made to provide non-damaging shoes for golf by including mechanisms to extend the spikes only when needed. Such mechanisms include cleats that are cranked by hand or moved by one or more levers. These retracting spikes have been found to have certain disadvantages of their own. For example, the mechanism may be prone to becoming jammed by mud or rust. The mechanism may be so difficult to operate that it is necessary to sit down to safely extend or retract the spikes. The inevitable mud and grass that creep into the moving parts cause wear and corrosion, shortening the useful life of the mechanism. Mechanical mechanisms add to the weight of the shoe and make the sole less flexible. Thus, despite attempts to create better shoes, golf players still have considerable inconvenience associated with their footwear.

There is a great need for shoes that provide traction when needed but that do not have the disadvantages of conventional golf spikes. There is further a need for spikes that do not damage golf greens or other fine-textured grass. There is a need for a golf shoe that can be worn on the course, in the clubhouse or other buildings, and for walking on sidewalks and across parking lots without excessive wear. There is a need for a durable spiked shoe that is safe to walk in on all surfaces.

In the case of retracting spikes, there is a need for a shoe that is easy enough to operate that it does not interrupt the game unduly or require the user to sit. Such a shoe would preferably be self-contained and not require the wearer to carry auxiliary equipment or replace expendable parts.

SUMMARY OF THE INVENTION

The present invention is a sole assembly for a shoe for golf or other sports, with plastic or metal spikes that may be easily extended when needed and retracted when not needed. The spikes are activated by pneumatic pressure that is generated by the wearer's own walking action. The selection mechanism for extending or retracting the spikes is a switch that can be operated with a single click.

The sole assembly includes an integral pump that selectively compresses air, powered by the wearer's weight. The compressed air expands plenum chambers that exert downward force on spike assemblies. Air pressure is maintained by check valves. The spikes protrude from apertures in the outsole then retract when air pressure is released. Mud and grass are scraped from the spikes as they retract.

Plenum chambers are embedded between midsole and outsole. Each spike is attached to a rigid ferrule, which moves like a piston inside the complementarily-shaped chamber. The ferrule is connected to, or embedded within, a flexible plenum membrane. The chamber walls support the plenum membrane such that over-distortion of the material does not occur, thereby prevent cracking of the rubber from stress.

The plenum membranes are biased in an upward position. When air pressure is released by actuating the switch, membranes, ferrules, and attached spikes retract into the sole.

All components of the sole assembly, including valves, may be constructed from synthetic polymeric materials to avoid corrosion and any need for external lubrication. The pump device consists of a compressible bladder and a an optional pressure reservoir, both made of resilient rubber. They are designed to flex with the sole assembly and not create discomfort to the wearer. All materials are selected for durability and reliability of the sole assembly.

BRIEF DESCRIPTION OF THE DRAWINGS

FIGS. 5A and 5B are bottom, side perspective views, partly cut away, of the sole assembly of FIG. 1 in the retracted and extended positions, respectively.

FIG. 6 is a bottom perspective view of the midsole portion of the sole assembly of FIG. 1.

FIG. 7 is a top perspective view of the outsole portion of a second preferred embodiment of the sole assembly of the present invention.

FIGS. 8A and 8B are cross-sectional views showing an alternative preferred embodiment of plenum chambers and spike assemblies in retracted and extended positions, respectively.

DETAILED DESCRIPTION OF THE INVENTION

The present invention is a system of extendable spikes for a sole assembly 10 that may be attached to many styles of shoe upper (not shown) to create a shoe with cleats or spikes that may be extended or retracted depending on need.

Figure 1:
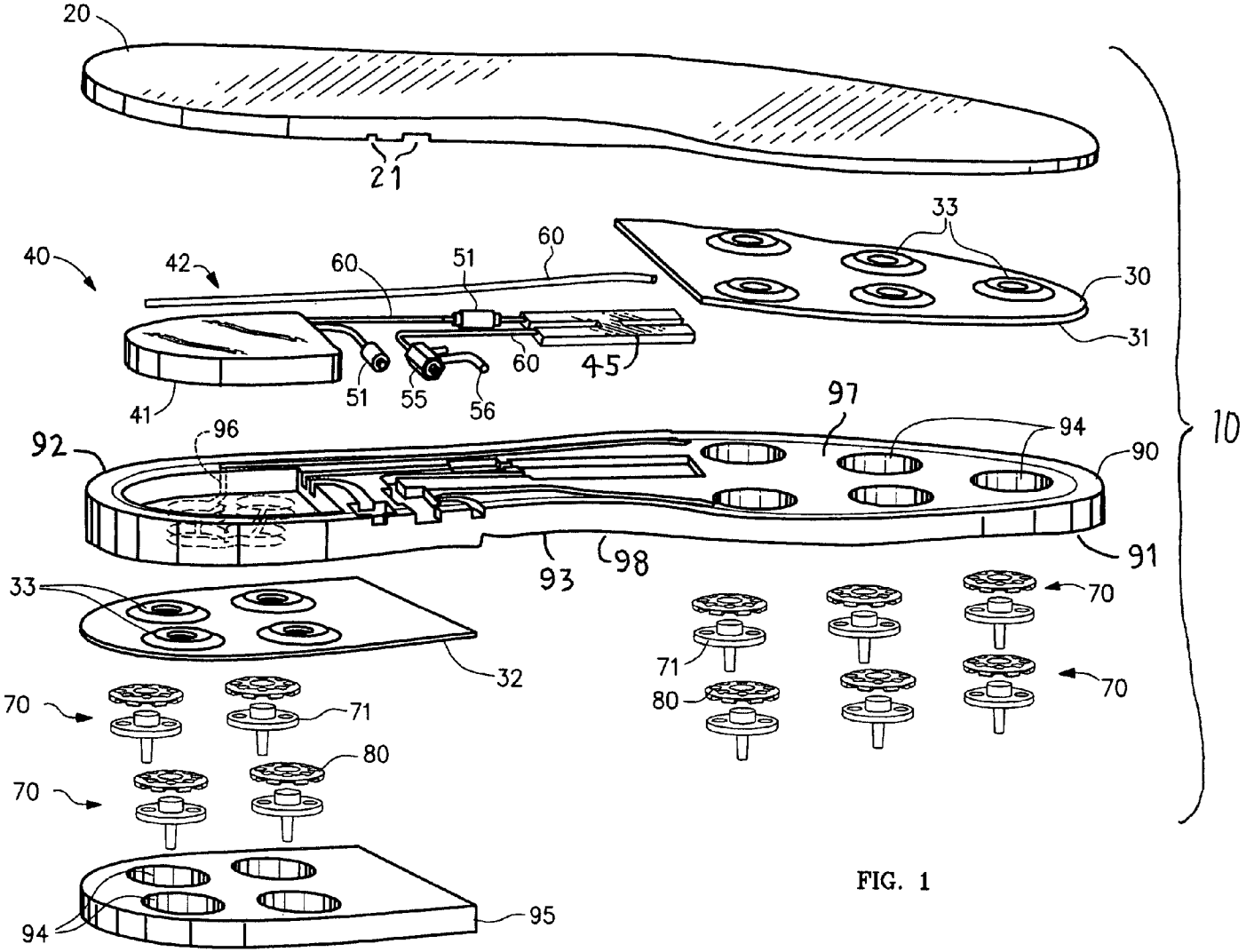
FIG. 1 is an exploded side perspective view of a first preferred embodiment of the sole assembly of the present invention.

FIG. 1 is an exploded side perspective view of sole assembly 10 of a first preferred embodiment 10A of the present invention. Sole assembly 10A generally includes a midsole 20 for attaching to a shoe upper, an outsole 90 for providing a durable walking surface, spike assemblies 70 that selectively protrude from the bottom of outsole 90, and a pneumatic system 40 that activates the movement of spike assemblies 70 by compressed gas, such as air.

Outsole 90 includes a front portion 91 for supporting the front part of a foot, a rear portion 92 for supporting the heel of a foot, and an arch portion 93 for supporting the arch of a foot. Typically, a shoe heel 95 of especially durable material is attached to the bottom of rear portion 92. With shoe heel 95 attached, heel 95 and front portion 91 contact the ground when the wearer walks; arch portion 93 either does not contact the ground or does not bear much weight.

Outsole 90 preferably includes shallow cut-outs in its upper face, to accommodate components of pneumatic system 40. A plurality of apertures 94 pierce outsole 90 from upper face 97 to bottom face 98. Apertures 94 also pierce shoe heel 95 in like manner. Pneumatic system 40 further includes heel pneumatic subsystem 43, which activates the movement of spike assemblies 70 through shoe heel 95.

Midsole 20 and outsole 90 are attached together, such as by adhesive as is well known in the art, with a plenum membrane 30 sandwiched between. Midsole 20, outsole 90, and plenum membrane 30 when attached together collectively form a sole body 15. Plenum membrane 30 is a sheet of strong resilient material such as nitrile, Viton, silicone rubber, or other suitable material, which includes a plurality of plenum members 33 formed into it, such as by a molding process. Plenum membrane 30 may be front plenum membrane 31, adapted to be sandwiched between midsole 20 and front portion 91 of outsole 90; or may be heel membrane 32, adapted to be sandwiched between rear portion 92 of outsole 90 and shoe heel 95.

Sole assembly 10 further includes a plurality of spike assemblies 70, consisting of a spike body 71 for providing traction and a ferrule 80, which might also be comprehended as a thrust bearing for moving spike body 71 between a retracted and an extended position.

Figure 2:
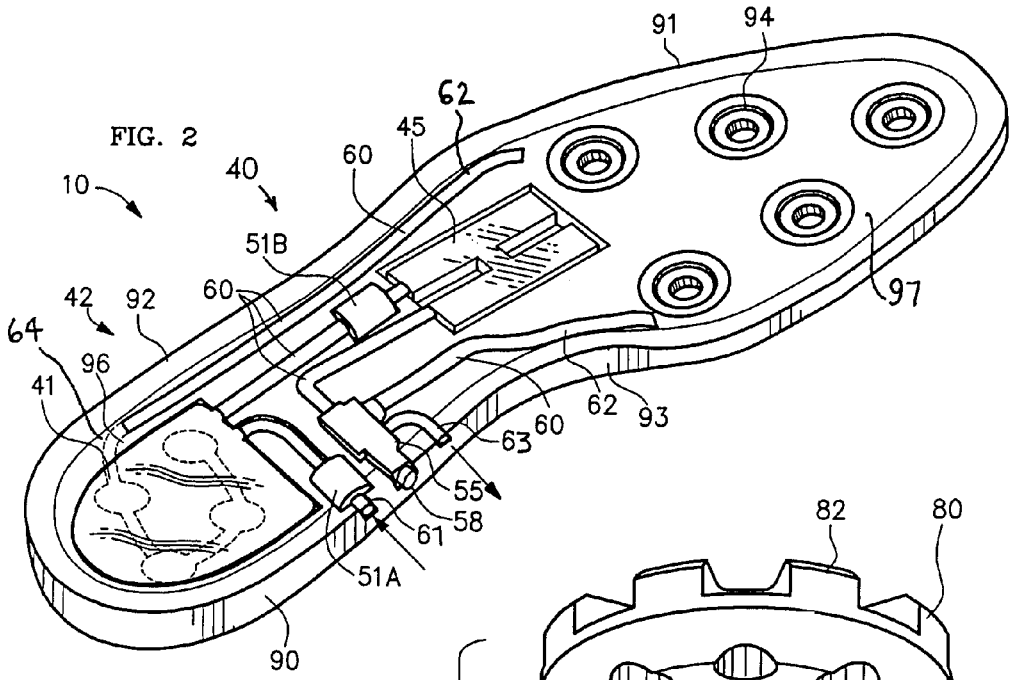
FIG. 2 is a top perspective view of the outsole portion of the sole assembly of FIG. 1, with most pneumatic components in place.

FIG. 2 is a top perspective view of outsole 90, with many of the components of pneumatic system 40 installed in their respective cut-outs. Looking at FIGS. 1 and 2, pneumatic system 40 includes pump means 42 for supplying compressed air to activate spike assemblies 70, switch valve 55, and sections of tubing 60 connecting the components such that compressed gas can be conducted to spike assemblies 70 or released to the atmosphere, as needed.

Pump means 42 is for supplying compressed air to activate movement of spike assemblies 70 from retracted to extended position. In the first preferred embodiment 10A shown and described in FIGS. 1-5, pump means 42 consists of a hollow, compressible bladder 41, a compressed air reservoir 45 in pneumatic communication with bladder 41, such as being connected by tubing 60, and two check valves 51A, B for maintaining air pressure within pneumatic system 40 at a selected value. Compression of bladder 41, such as by the wearer's weight during walking, forces air into reservoir 45, where pressure builds with each step.

Other means for providing compressed air through a wearer's walking movement are envisioned but not illustrated, such as a flexible hollow pipe arranged in serpentine fashion within sole body 15 so as to be compressed progressively from rear to front as the wearer steps first on heel 95 then transfers weight toward front portion 95.

Bladder 41 has a resilient bias toward being in an expanded position. Bladder 41 is compressed by the weight of the wearer's downward step and the air inside bladder 41 is forced into reservoir 45. As the wearer steps forward and lifts weight from above bladder 41, bladder 41 returns to the expanded position, drawing in additional air through inlet tube 63.

Bladder 41 is most efficiently shaped to conform to the outline of the bottom of wearer's heel, although design details may vary. Reservoir 45 may be of the same shape as bladder 41 or of other shapes chosen for efficient operation and fit within sole assembly 10. In the preferred embodiment illustrated herein, reservoir 45 is shown as a pair of elongate tubes that are connected together. The reason for separating reservoir 45 into two elongate halves is to provide a shape that flexes with the wearer's foot so as not to impede walking.

A plurality of apertures 94 disposed in front portion 91 of outsole 90 are shaped to receive plenum members 33 and ferrules 80 from above and spike bodies 71 from below. In the preferred embodiment shown and described herein, plenum members 33 are portions of plenum membrane 30 that are formed during the molding process to be in the shape of dome springs that are upwardly biased. The complex shape of plenum members 33 can best be understood from FIG. 3, as will be explained below.

Figure 4:
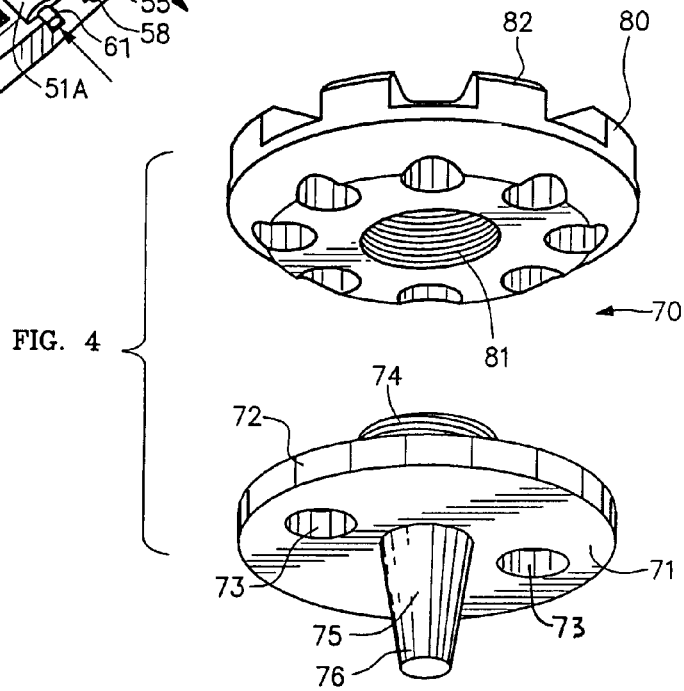
FIG. 4 is an enlarged, exploded perspective of the spike assembly of FIG. 1.

FIG. 4 is a bottom perspective view of spike assembly 70. Spike assembly 70 includes spike body 71 and ferrule 80. Spike body 71 includes a threaded connector 74, and ferrule 80 includes a threaded hole 81 for accepting threaded connector 74. Ferrule 80 has a top surface 82.

Spike body 71 further includes a flange 72 and a spike shaft 75 including a tip 76 for contacting the ground and increasing traction. Flange 72 includes a plurality of engagement holes 73 for accepting a pronged tool (not shown) to aid connecting and disconnecting spike body 71 to and from ferrule 80, such as to replace spike body 71 if tip 76 is damaged.

Each plenum member 33 is attached to top surface 82 of one ferrule 80. This may be accomplished by gluing. In the most preferred embodiment, plenum members 33 are created by molding suitable material in the shape of front membrane 31 and heel membrane 32. Furthermore, it is most preferred to attach ferrules 80 to plenum members 33 by the process of co-molding, as is well known. That is, an appropriate number of ferrules 80 are placed into a prepared mold then the molten rubber material is forced into the mold to create front and heel membranes 31, 32 in which each ferrule 80 is embedded strongly beneath ene-its associated plenum member 33.

Plenum members 33 may alternatively be individual units that are not connected together. Plenum members 33 may take various forms other than the one illustrated and described herein, as may be readily appreciated by those skilled in the art.

FIGS. 5A and 5B are top, side perspective views, partly cut away, of sole assembly 10A of FIG. 1 in the retracted and extended positions, respectively. FIG. 6 is a bottom perspective view of the midsole portion of the sole assembly of FIG. 1.

As seen in FIG. 6, the bottom face of midsole 20 includes plenum cutouts 24 that mirror the position of apertures 94 in outsole 90. However, plenum cutouts 24 are relief cutouts only and do not pass through midsole 20. Plenum cutouts 24 are connected in series by air channel 22. Air channel 22 is disposed so as to align with the outlet of supply tube 62, best seen in FIG. 2.

When outsole 90, plenum membrane 30, and midsole 20 are attached together to create sole body 15, air channel 22 cooperates with supply tube 62 to supply compressed air to all plenum members 33 of front plenum membrane 31. After passing through air channel 22, compressed air enters heel tubing 64 and is conducted downwardly through borehole 96 to activate plenum members 33 of heel membrane 32.

Figure 3A:
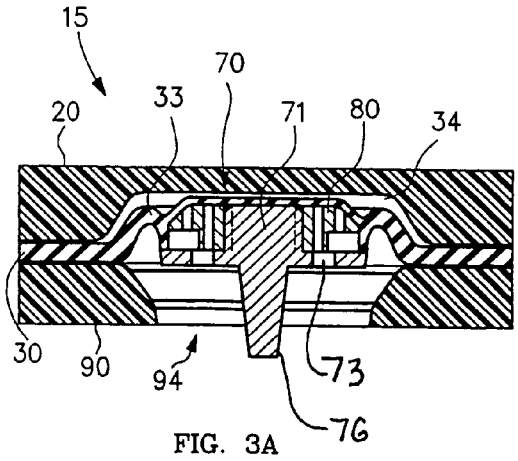
FIGS. 3A and 3B are cross sectional views taken along lines 3A-3A and 3B-3B of FIGS. 5A and 5B, respectively, of a first preferred embodiment of plenum chambers and spike assemblies shown in retracted and extended positions, respectively.
Figure 3B:
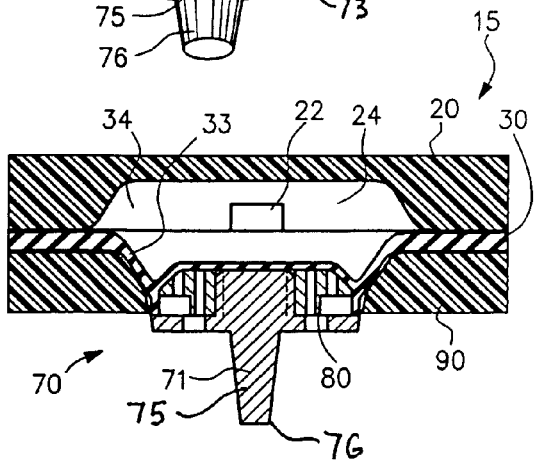

Looking especially now at FIGS. 3A and 3B, it can be seen that spike assembly 70 is moved from a retracted position (FIG. 3A) to an extended position (FIG. 3B) by expansion of plenum (or "expansion") chamber 34. In FIG. 3A, plenum chamber 34 is in contracted position, plenum member 33 of plenum membrane 30 and ferrule 80 are almost entirely retracted within plenum cutout 24, and spike tip 76 barely protrudes below the bottom surface of outsole 90.

In FIG. 3B, plenum chamber 34 is in expanded position due to introduction of compressed air through air channel 22, the end of which is seen at the back of plenum chamber 34. Plenum chamber 34 is defined by plenum cutout 24 forming its upper wall and the upper portion of the side walls and by plenum member 33 forming its bottom wall and bottom portion of side walls. Plenum cutout 24 is relatively rigid and is unaffected by introduction of compressed air. Plenum member 33 is resilient and movable, and everts downward when the pressure within plenum chamber exceeds its design value, typically about 5-45 psi. When plenum member 33 is forced downward as in FIG. 3B, it pushes spike assembly 70 to its extended position in which the entire spike shaft 75 protrudes below the bottom of outsole 90.

In FIG. 3A, plenum member 33, in contracted position, can be seen to be a generally dome-shaped portion of plenum membrane 30, with spike assembly 70 attached beneath the upwardly-biased dome. In FIG. 3B, plenum member 33 has been moved to an everted position by the pressure of compressed gas or air introduced between midsole 20 and plenum membrane 30 through tubing 60, connected to pump means 42. In the everted position of FIGS. 5B and 3B, a plenum cavity 34 is created, which is maintained in the expanded position by being filled with compressed air from pump means 42.

Plenum member 33 functionally resembles what is known as a "dome spring." However, plenum member 33 has a more complex shape than a simple dome to allow it to fit tightly around ferrule 80 and also adapt plenum member 33 to move spike assembly 70 a longer downward distance than a simple dome would allow. When plenum member 33 moves from its contracted to its everted position, plenum member 33 "pops" from contracted to everted position without significant stretching of any portion of plenum member 33. In the everted position, the walls of plenum member 33 are supported by the shaped walls of aperture 94 and by rigid ferrule 80 so as to protect plenum member 33 against over-expansion. The shape of plenum member 33 and support from aperture 94 and ferrule 80 cooperate to provide a movement mechanism for spike assemblies 70 that is very durable and robust.

FIGS. 3A and 3B show midsole 20 as including cut-out portion 24 to accept each plenum member 33 in its contracted position and to form part of the volume of plenum cavity 34 when plenum member 33 is everted. This is a preferred embodiment of the present invention, but alternative designs are possible and will be obvious to those with skill in the art.

To assemble sole assembly 10, midsole 20 is attached to an appropriate shoe upper (not shown) as is well known. The shoe upper may be of a sort suitable for wearing while playing sports, including golf or soccer, or may be of a sort suitable to wear hiking on loose soil or mud, or for walking on snow or ice.

Front plenum membrane, with attached ferrules 80, is placed over front portion 91 of outsole 90 such that ferrules 80 each nest into an aperture 94. The components of pneumatic system 40 are placed in their respective cut-outs in outsole 90. As shown in FIG. 2, sections of tubing 60, such as flexible tubing of durable synthetic rubber, are used to connect the components. Tubing 60 includes an intake tube 61, supply tube 61; outlet tube 63, and heel tube 64.

Supply tube 62 connects the plenum members 33 in series to pump means 42 via switch valve 55. Plenum members may be connected to each other by small sections of tubing 60, or by air channels 22 cut into the bottom surface of midsole 20 as shown in FIG. 6. Heel tube 64 passes through a borehole 96 through outsole 90 to supply compressed gas to heel subsystem 43. Spike assemblies 70 are typically disposed in the front and heel portions of the sole assembly only, because arch portion 93 does not bear much weight of the wearer.

After the upper portion of pneumatic system 40 is assembled on the top surface of outsole 90 and heel tube 64 is inserted into borehole 96, midsole 20 and outsole 90 are attached together with plenum membrane 30 between them. Typically, suitable adhesive is spread over the flat (non-cut-out) upper surfaces of outsole 90 and the complimentary surfaces of the bottom of midsole 20. Then midsole 20 and outsole 90 are pressed together, optionally in a mold, so as to create a gas-tight bond among outsole 90, midsole 20, and plenum membrane 30.

In similar manner, heel pneumatic subsystem 43 is assembled on the bottom of outsole 90 and outsole 90 and shoe heel 95 are glued together with heel membrane 32 sandwiched between them. Heel tube 64 connects the plenum members 33 in series to pump means 42 so as to activate spike assemblies 70 located in heel 95.

Because air channel 24 will not function efficiently if partially obstructed by adhesive, the adhesive applied between midsole 20 and outsole 90, and between outsole 90 and heel 95, is preferably metered and located precisely. This may be done by use of a sheet of preformed solid adhesive, by screen printing the adhesive, by offset printing, by machine-controlled syringe dispensing, or similar technique as is well known.

Finally, spike bodies 71 are connected to ferrules 80 by screwing connectors 74 into threaded holes 81. Optionally, a tool (not shown) with prongs adapted to fit into engagement holes 73 may be used to rotate spike body 71.

As the wearer walks, bladder 41 is alternately compressed and released. When bladder 41 is released, bladder 41 fills to its natural expanded state by drawing air through inlet tubing 61 and check valve 51. When bladder 41 is compressed, the air is prevented by check valve 51A from returning through inlet tube 61, so the air is forced onward from bladder 41 into pressure reservoir 45 via check valve 51B.

The air then flows to switch valve 55, which includes a switch, such as pushbutton 58, or a toggle switch, rocker switch, or other suitable switch means. Switch valve 55 can direct air received from reservoir 45 either to supply tube 62 or to outlet tube 61, as selected by the wearer using pushbutton 58.

If "relief" mode is selected, a small amount of air is drawn into inlet tube 61 and released from outlet tube 63 with each step. The pressure of this circulating air is not enough to evert plenum members 33 and extend spike tips 76 against the weight of the wearer.

To activate spike assemblies 70 to increase the traction of the shoe during wearing, switch valve 55 is set to retain pressure within pneumatic system 40. Pushbutton 58 may be manipulated by hand, by tapping it with a golf club or hiking stick, or by tapping the heel of one shoe against the switch 28 of the other shoe. Only a single click is required to change switch valve 55 from "pressure" mode to relief mode, or vice versa.

With switch valve 55 in pressure mode, compressed air from reservoir 45 is directed through supply tube 62 to pressurize plenum members 33. The pressure is usually sufficient to evert plenum members 33 immediately and extend spike tips 76 substantially below outsole 90. Should there be insufficient pressure stored in reservoir 45, pump means 42 will add the additional pressure needed as the wearer takes the next few steps. Switch valve 55 maintains pneumatic system 40 closed so that spike tips 76 remain extended and support wearer's weight.

Check valves 51A, B are adapted to maintain pneumatic system 40 at a pre-determined pressure when pressure mode is selected. Check valves 51A, B prevent backflow of compressed air until the target pressure is reached. After that, check valves 51A, B will allow excess air to escape, in order to prevent undue stress on pneumatic system 40 and to maintain a comfortable flexibility and softness of sole assembly 10 for walking.

Depending upon the intended use for a shoe with the sole assembly 10 of the present invention, the bottom surface of outsole 90 may be generally smooth. In this case, it may be preferable that spike body 71 be dimensioned such that tip 76 is flush with the bottom surface of outsole 90 or retracts to be slightly above the bottom of outsole 90.

Alternatively, outsole 90 may have permanent tread features such as ripples, ridges, or other texture pattern. In this case, it may be desirable that spike body 71 retract only sufficiently that tip 96 protrudes slightly from outsole 90 in the retracted position. Many design choices may be made while enjoying the advantages of the present invention.

Turning now to FIGS. 7 and 8, an alternative preferred embodiment of the invention is illustrated. FIG. 7 is a top perspective view of the outsole portion of a second preferred embodiment of the sole assembly of the present invention. Apertures 94 are adapted to receive plenum chambers 34 as previously described, but not shown in FIG. 7.

Sole assembly 10B of Figure differs from sole assembly 10A in three main ways. Sole assembly 10B does not include reservoir 45; supply tubing 62 connects apertures 94 for plenum chambers 34 in parallel rather than in series; and apertures 94 are shaped to receive discrete plenum assemblies 50 rather than a plenum membrane 30. Additionally, heel pneumatic sub-system 43 is not shown, but may optionally be included.

It has been found that reservoir 45 is not needed in all applications. The purpose of reservoir 45 is to retain a quantity of compressed air to extend spike assemblies 70 nearly instantaneously on demand. However, depending upon the number of spike assemblies and the total volume of all plenum chambers 34 relative to the volume of bladder 41, spike assemblies 70 may be fully extended and firm with only two or three steps by the wearer. In this case, reservoir 45 may be omitted if desired. If reservoir 45 is omitted, switch valve 55 and associated tubing 60 is rearranged as appropriate.

Sole assembly 10B has supply tubing 62 arranged in a "tree" configuration to actuate spike assemblies 70 in parallel. This configuration is found to pressurize quickly and reliably, especially if the pressurized air is conducted by cylindrical tubing 62 that is laid into channels 24 instead of being conducted by channels 24 themselves, as described above. The use of separate tubing instead of channels 24 to conduct pressurized air may make for a more complex and expensive sole assembly 10B, yet simplifies the gluing operation and may result in a more robust product.

Each plenum assembly 50 that is supplied by tubing 62 in the tree configuration may optionally be provided with an individual check valve, not shown, to help maintain spike assemblies 70 in an extended position even if one spike assembly 70 should develop a small leak.

FIGS. 8A and 8B are cross-sectional views showing an alternative preferred embodiment of plenum assemblies 50 and spike assemblies 70B in retracted and extended positions, respectively. Plenum assembly 50 is a discrete unit that is installed into aperture 94. Plenum assembly 50 generally includes chamber cylinder 36, which is a cylinder with one closed end, made for example from a thermoplastic material. Chamber cylinder 36 typically has 2-2.7 cm inside diameter and 1-1.5 cm inside height. Chamber cylinder 36 includes an aperture such as air port 37 that receives supply tubing 62 for pressurizing plenum chamber 34B. Chamber cylinder 36 includes a wall cylinder 53 and top surface 54.

In the embodiment shown in FIGS. 8A and 8B, plenum membrane 33B is a discrete "dome spring" that fits snugly into the open end of chamber cylinder 36. Embedded within plenum membrane 33B is a rigid ferrule 80, such as of metal, that includes a threaded hole 81 for receiving spike body 71. Ferrule 80 is typically embedded in plenum membrane 33B by a co-molding process or may be attached such as by adhesive. Spike body 71 is rigid, such as of metal or strong plastic, and includes threaded connector 74 for connection to threaded hole 81 and tool eyelet 77 for accepting a slender tool to facilitate rotation of spike body 71 in threaded hole 81 for installation or removal.

Cover plate 35 covers the bottom of plenum membrane 33B. Cover plate 35 is generally a disk with a central spike aperture 38 through which spike shaft 75 protrudes. Cover plate 35 and chamber cylinder 36 typically include reliefs or flanges as needed to help plenum membrane 33B seat securely between cover plate 35 and chamber cylinder 36. As shown in FIGS. 8A and 8B, cover plate 35 also includes centering guide 39. Centering guide 39 is a stiff ring around central hole 38 that causes spike shaft 75 to extend perfectly normal to cover plate 35 even under the weight of the wearer. Centering guide 39 further stiffens cover plate 35 so that cover plate 35 does not deflect when plenum chamber 34B is pressurized.

To assemble plenum assembly 50, chamber cylinder 36, plenum membrane 33B with embedded ferrule 80, and cover plate 35 are assembled together as shown in FIGS. 8A and 8B, such as by co-molding or adhesive.

A plurality of plenum assemblies 50 are inserted into apertures 94 of outsole 91. Supply tubing 62 is connected to each air port 37 so that each plenum chamber 34B is in communication with switch valve 55 for receiving pressurized air from bladder 41. Pump means 42 actuates extension and retraction of spike bodies 71 as described above.

Sole assembly 10B may be attached to any suitable shoe midsole and upper, not shown. The midsole should preferably be of sufficient thickness to accommodate plenum assemblies

50 so that the wearer feels no discomfort from plenum assemblies 50. Optionally, an additional, easily removable cover sole (not shown) with small spike holes may be attached under outsole 91. Cover sole may be stripped away after the shoe is worn to easily remove built up mud or other debris.

Spike shafts 75 are shown in FIGS. 8A and 8B as slender and pointed. If spike shaft 75 should become damaged or blunted, spike shaft 75 is conveniently replaced by inserting a slender tool, such as a small nail, through eyelet 77 and using the tool to rotate spike shaft 75 until threaded connector 74 is released from threaded hole 81. A fresh spike shaft 75 is then installed in similar manner.

In yet a third envisioned embodiment of the invention, a spike module 100 can be created separately from the manufacture of a shoe. Spike module 100 generally comprises plenum assembly 50 of FIGS. 8A and 8B, including spike assembly 70. Spike module 100 can be installed within a suitable shoe by a second party and connected to any suitable source of pressurized fluid such as carbon dioxide, water, propylene glycol, or compressed air.

Although particular embodiments of the invention have been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

What is claimed is:

1. A spike module for installing in a shoe for providing increased traction for the shoe on demand; said spike module activated by a source of pressurized air; comprising:

a chamber cylinder for receiving pressurized air; including:

an inlet aperture connected to a source of pressurized air;

a plenum membrane dividing said chamber horizontally into an upper plenum chamber for receiving pressurized air via said inlet aperture; and a lower chamber; said lower chamber including:

a spike aperture; and a spike assembly attached to said plenum membrane; including:

a spike shaft connected to said membrane; including:

a spike tip disposed near said spike aperture; and wherein: introduction of pressurized air into said chamber causes said plenum membrane to flex and cause said spike tip to be extended through said spike aperture and maintained firmly until pressure is released.

2. The spike module of claim 1; said chamber further comprising:

a cylinder;

a top surface connected to said cylinder around the perimeter of said cylinder;

a cover plate; including:

said spike aperture; said plenum membrane disposed between said cylinder and said cover plate and attached therebetween to form a fluid-tight seal.

3. The spike module of claim 1, the pressurized air comprising: air that has been compressed to a pressure in the range of 5 to 45 pounds per square inch by the walking motion of a person.

4. The spike module of claim 1, said chamber cylinder further including:

a single air port for receiving pressurized air into said upper plenum chamber; and a check valve disposed upstream of said air port.

* * * * *